US011859358B2

(12) United States Patent
Gamache

(10) Patent No.: US 11,859,358 B2
(45) Date of Patent: Jan. 2, 2024

(54) SLEIGH SHOVEL

(71) Applicant: INOTEV INC., Adstock (CA)

(72) Inventor: Yves Gamache, Adstock (CA)

(73) Assignee: INOTEV INC., Adstock (CA)

( * ) Notice: Subject to any disclaimer, the term of this patent is extended or adjusted under 35 U.S.C. 154(b) by 695 days.

(21) Appl. No.: 17/012,373

(22) Filed: Sep. 4, 2020

(65) Prior Publication Data

US 2021/0071377 A1 Mar. 11, 2021

Related U.S. Application Data

(60) Provisional application No. 62/896,656, filed on Sep. 6, 2019.

(51) Int. Cl.
*E01H 5/02* (2006.01)

(52) U.S. Cl.
CPC ..... *E01H 5/02* (2013.01)

(58) Field of Classification Search
CPC ..... E01H 5/02
See application file for complete search history.

(56) References Cited

U.S. PATENT DOCUMENTS 3,107,446 A * 10/1963 Messinger ..... E01H 5/02 280/654
3,121,963 A * 2/1964 Nolan ..... E01H 5/02 298/28
3,483,643 A * 12/1969 Erickson ..... E01H 5/02 15/236.01
4,299,419 A * 11/1981 Kalan ..... F24B 1/1915 294/9
5,018,282 A * 5/1991 Hong ..... E02F 3/02 37/434
5,048,206 A * 9/1991 Jones ..... B62B 1/147 37/434
5,123,187 A * 6/1992 Zamaria ..... E01H 5/02 D34/24
5,581,915 A * 12/1996 Lobato ..... E01H 5/02 280/47.38
6,219,944 B1 * 4/2001 Byers ..... E02F 3/02 37/285
7,111,418 B2 * 9/2006 Noonan ..... E01H 5/02 37/285
7,681,932 B2 * 3/2010 Chang ..... E01H 5/02 294/54.5
2015/0308059 A1 * 10/2015 Khan ..... E01H 5/02 37/284

* cited by examiner

*Primary Examiner* — Gary S Hartmann
(74) *Attorney, Agent, or Firm* — Wood, Phillips, Katz, Clark & Mortimer

(57) ABSTRACT

A sleigh shovel includes a scoop having lateral panels, a rear panel extending between the lateral panels and a bottom panel extending between the lateral panels. The shovel further includes a push bar assembly extending from the scoop, an actuation assembly and a discharge mechanism connected to the scoop. The discharge mechanism includes a sliding wall mounted within the scoop in an upright position and operatively connected to the actuation assembly, and an adjustable panel mounted between the lateral panels and operatively connected to the actuation assembly. The sleigh shovel being operable between a scooping configuration for containing and transporting material within the scoop, and a discharge configuration, for discharging material from the scoop upon manual operation of the actuation assembly.

18 Claims, 12 Drawing Sheets

SLEIGH SHOVEL

CROSS-REFERENCE TO RELATED APPLICATIONS

This application claims priority under 35USC§ 119(e) of U.S. Provisional Application No. 62/896,656, filed Sep. 6, 2019, entitled "SLEIGH SHOVEL", the entirety of which are hereby incorporated by reference.

TECHNICAL FIELD

The technical field generally relates to shovels, and more particularly to shovels having a discharge mechanism to facilitate unloading thereof.

BACKGROUND

Shoveling snow can be a strenuous, tiring and lengthy task. Over the years, new shovel designs have been sold on the market to facilitate this task by reducing the risk of injury and minimizing the time needed to shovel a certain amount of snow. For example, sleigh shovels such as the one illustrated in U.S. Pat. No. D667,283 were developed to allow a user to haul larger volumes of snow with each shovel.

However, unloading these large hauls often requires the scoop of the shovel to be flipped/tipped over to empty its content on the ground. Large hauls of snow can be quite heavy and thus tipping over a shovel full of snow can be just as strenuous and tiring as shoveling by hand.

There is therefore a need for a sleigh shovel able to overcome at least some of the shortcomings of known shovels.

SUMMARY

According to a first aspect, a sleigh shovel is provided. The sleigh shovel includes a scoop having lateral panels, a rear panel extending between the lateral panels and a bottom panel extending between the lateral panels. The sleigh shovel also has a push bar assembly extending from the scoop, an actuation assembly and a discharge mechanism connected to the scoop. The discharge mechanism having a sliding wall mounted within the scoop in an upright position and operatively connected to the actuation assembly and an adjustable panel mounted between the lateral panels and operatively connected to the actuation assembly. The sleigh shovel being operable between a scooping configuration, where material can be contained and transported within the scoop, and a discharge configuration, where material can be discharged from the scoop upon manual operation of the actuation assembly.

According to a possible embodiment, the panels of the scoop define a discharge opening at a front section thereof for unloading material.

According to a possible embodiment, the adjustable panel is operable between an advanced position and a retracted position upon operation of the actuation assembly, wherein when in the advanced position, the adjustable panel covers the discharge opening and when in the retracted position, the discharge opening is uncovered.

According to a possible embodiment, the discharge mechanism comprises bottom grooves positioned along the lateral panels and wherein the adjustable panel is adapted to slide along the bottom grooves upon operation of the actuation assembly.

According to a possible embodiment, the adjustable panel slides rearwardly, below the bottom panel, upon operation of the actuation assembly.

According to a possible embodiment, the sliding wall is operable between a scooping position proximate the rear panel and a discharge position proximate the discharge opening upon operation of the discharge mechanism.

According to a possible embodiment, the discharge mechanism comprises sliding wall grooves positioned along the lateral panels and wherein the sliding wall is adapted to slide along the sliding wall grooves upon operation of the actuation assembly.

According to a possible embodiment, the discharge mechanism comprises at least one adjustable panel arm operatively connecting the adjustable panel to the actuating assembly.

According to a possible embodiment, the adjustable panel arm comprises a plurality of segments pivotally connected to one another.

According to a possible embodiment, the discharge mechanism comprises at least one sliding wall arm operatively connecting the sliding wall to the actuating assembly.

According to a possible embodiment, the sliding wall arm and adjustable panel arm are operatively connected to one another.

According to a possible embodiment, the sliding wall is connected to the lateral panels via tongue and groove connections.

According to a possible embodiment, the adjustable panel is connected to the lateral panels via tongue and groove connections.

According to a possible embodiment, the actuation assembly is adapted to engage both the sliding wall and adjustable panel simultaneously.

According to a possible embodiments, the actuation assembly comprises a lever, and the lever is pivotally connected to the push bar assembly.

According to a second aspect, there is provided a sleigh shovel for shoveling snow. The sleigh shovel includes a scoop for containing snow, a push bar assembly extending from the scoop and a discharge mechanism connected to the scoop. The discharge mechanism having an adjustable panel and a sliding wall operatively mounted within the scoop. The sleigh shovel also includes an actuation assembly, with the discharge mechanism being adapted to discharge the scoop from below upon manual operation of the actuation assembly.

According to yet another aspect, a method of displacing material using a shovel comprising a discharge mechanism operable via an actuator is provided. The method comprising the steps of scooping up material within the scoop from a first location; manually operating the actuator to discharge the scoop from below at a second location; and moving the sleigh shovel away from the discharged material to clear said discharged material from the scoop.

According to a possible embodiment, the actuator comprises a lever, and manually operating the actuator comprises pulling the lever.

According to another aspect, a sleigh shovel for shoveling snow is provided. The sleigh shovel includes a scoop for containing snow, a push bar assembly operatively connected to the scoop and a discharge mechanism connected to the scoop, the discharge mechanism displacing or clearing at least a portion of the bottom section of the scoop.

According to a possible embodiment, an actuating assembly can displace or move a portion of the bottom section of the shovel from a charging configuration to collect material, to a discharging configuration to discharge the material, when operated from a charging to a discharging position.

According to a possible embodiment, the sleigh shovel further includes a substantially upright/vertical wall, which can be displaced from a first, frontward position to a second, backward or retracted position.

According to a possible embodiment, the discharge mechanism retracts the bottom section of the scoop while concurrently rearwardly sliding the upright vertical wall, upon being actuated from the charging to the discharging position.

According to a possible embodiment, the actuating assembly comprises a set of hinges or linkages operatively connected to the scoop and the push bar.

DETAILED DESCRIPTION

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

In addition, although the optional configurations as illustrated in the accompanying drawings comprise various components and although the optional configurations of the sleigh shovel as shown may consist of certain geometrical configurations as explained and illustrated herein, not all of these components and geometries are essential and thus should not be taken in their restrictive sense, i.e. should not be taken as to limit the scope of the present disclosure. It is to be understood that other suitable components and cooperations thereinbetween, as well as other suitable geometrical configurations may be used to embody the shovel, and corresponding parts, as briefly explained and as can be easily inferred herefrom, without departing from the scope of the disclosure.

As will be explained below in relation to various embodiments, a sleigh shovel for shoveling and discharging snow, or other material, is provided. As is well known in the art, typical sleigh shovels include a scoop and a push bar connected to the scoop for handling thereof. It should be understood that, as used herein, the expression "scoop" refers to the part of the shovel adapted to contain the material to be shoveled. It should also be understood that the material to be shoveled can be any suitable material which can be contained, transported, pushed, displaced, etc. by a shovel, and is thus not limited to snow and/or sand. However, for simplicity and clarity, snow will be used as the main example of "material to be shoveled" throughout this disclosure. In addition, the sleigh shovel described herein includes a discharge mechanism operable to effectively discharge the scoop of its content in a manner that will be described below.

Figure 1:
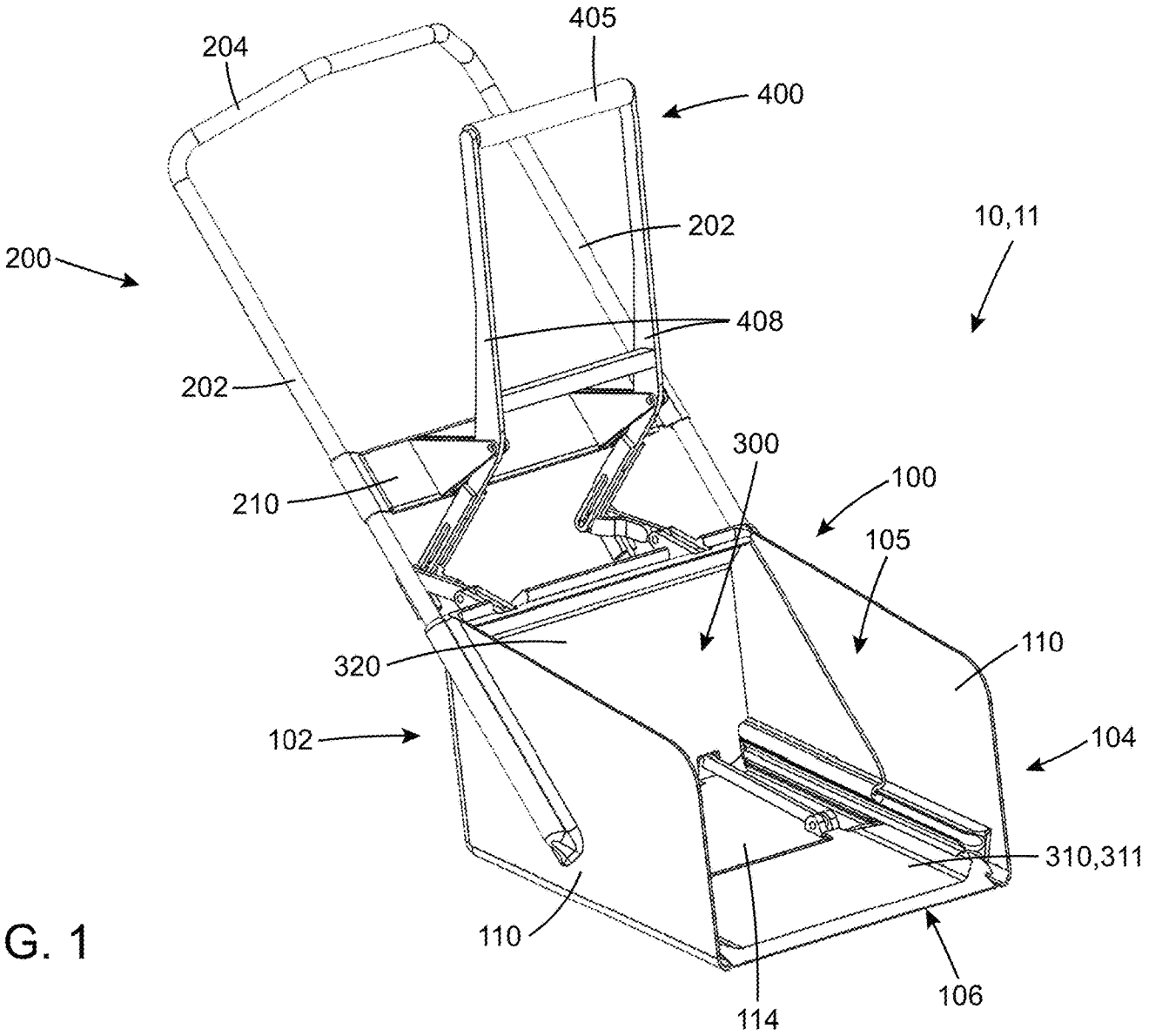
FIG. 1 is a front perspective view of a sleigh shovel having a discharge mechanism according to an embodiment.
Figure 2:
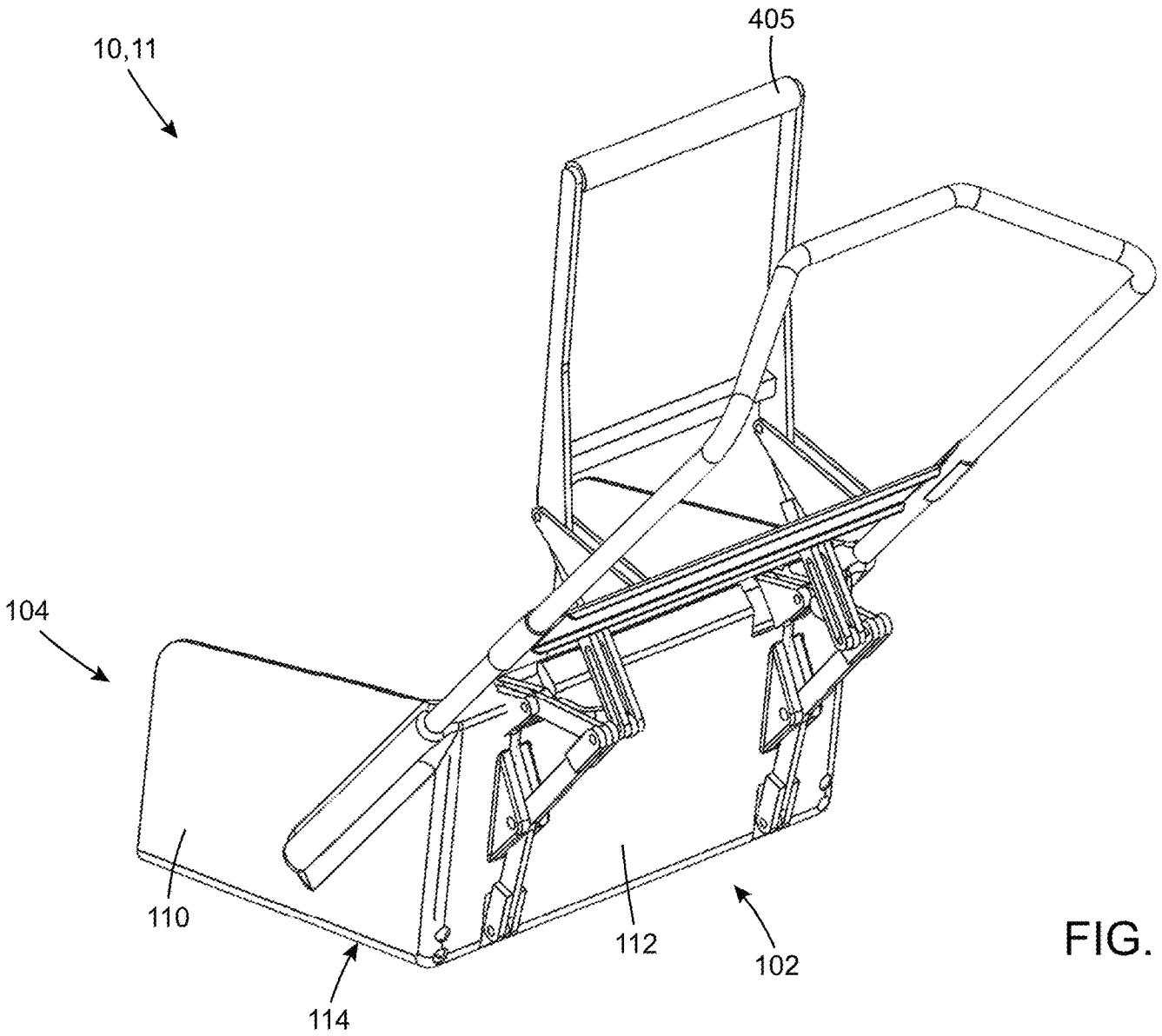
FIG. 2 is a rear perspective view of the sleigh shovel shown in FIG. 1.
Figure 9:
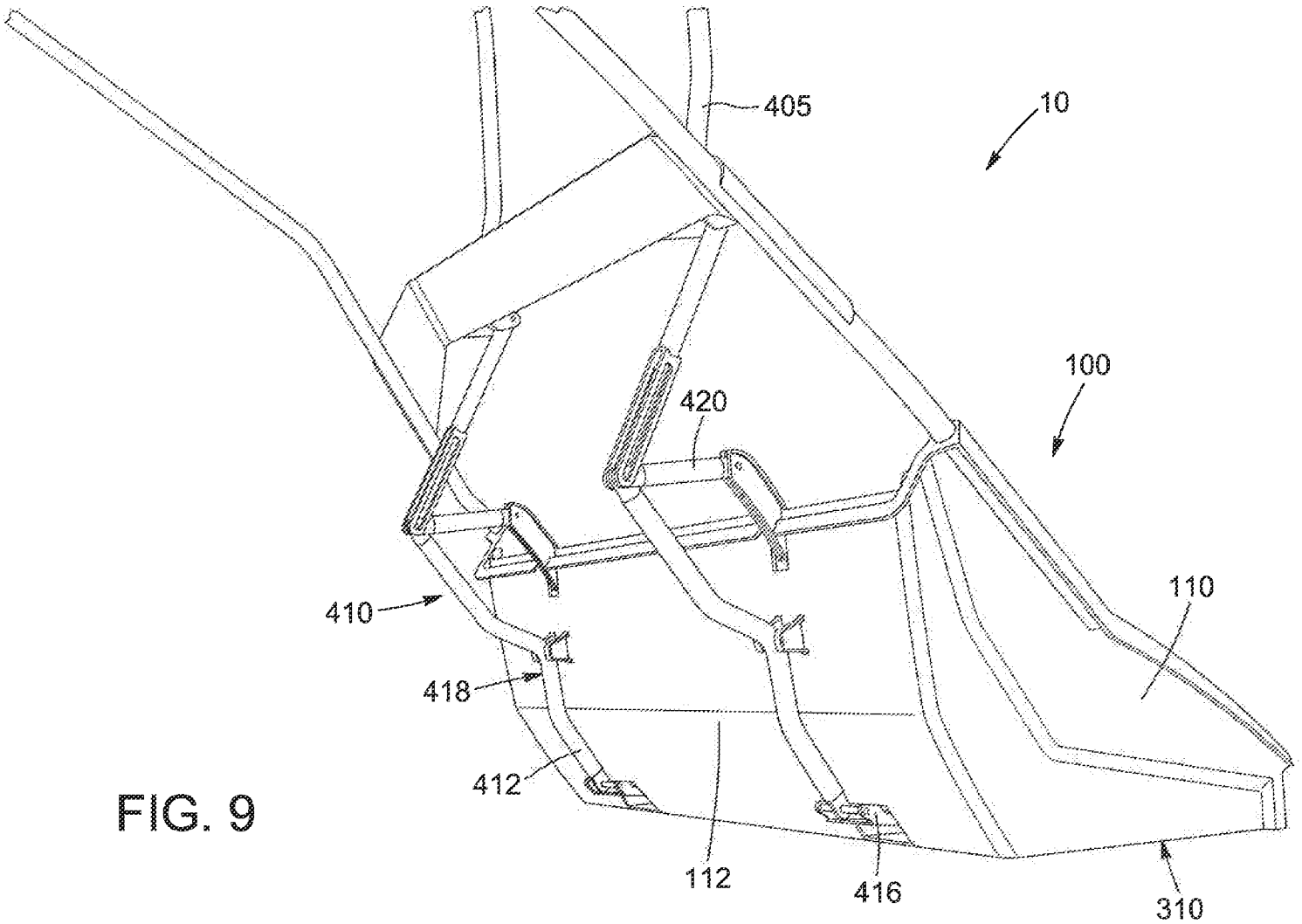
FIG. 9 is a rear perspective view of the sleigh shovel shown in FIG. 8.

Referring to FIGS. 1 and 2, a sleigh shovel 10 in accordance with an embodiment is shown. In this embodiment, the shovel 10 includes a scoop 100 comprising spaced apart lateral panels 110 connected to one another via a rear panel 112 and a bottom panel 114. The panels of the scoop 100 cooperate with one another and define a scoop interior volume 105 adapted to contain material (e.g., snow). In the present embodiment, the lateral panels 110 can be substantially parallel to one another, i.e., define a 90-degree angle with the bottom panel 114. However, it is appreciated that the rear and/or lateral panels 110, 112 can extend from the bottom panel 114 at any suitable angle (e.g., 45 degrees, 60 degrees, 120 degrees, 150 degrees, etc.), and can be at least partially curved along a length thereof. For example, the rear panel 112 shown in FIG. 9 is curved along a length thereof between the top and bottom edges. It should be noted that the scoop 100 can include a back section 102 proximate the rear panel 112, a front section 104 opposite the back section 102, and a front opening 106 defined at the front section 104. It should be understood that snow can thus enter the scoop interior volume 105 via the front opening 106 during shoveling of snow, as is well known in the art.

In some embodiments, the rear panel 112 and bottom panel 114 can be connected to one another in an L-shaped configuration, with the rear panel 112 extending upwardly from the bottom panel 114. In some embodiments, the bottom panel 114 can extend forwardly along substantially half the length of the scoop 100, defining a discharge opening 108 (FIG. 3) between the lateral panels 110 proximate the front section 102. The panels of the scoop 100 can be made of any suitable material, such as plastic for example, and connected to one another to form the scoop 100. Preferably, the scoop 100 is made as a one-piece unit via plastic injection molding, although it is appreciated that other methods are possible.

In this embodiment, the sleigh shovel 10 further includes a push bar assembly 200 operatively connected to the scoop 100 to facilitate handling thereof. In other words, the push bar can be connected directly or indirectly to the scoop via another component. The push bar assembly 200 can include a pair of longitudinal bars 202 respectively connected to and extending from a corresponding one of the lateral panels 110, and a transversal bar 204 connecting the longitudinal bars 202 at a top end thereof. In some embodiments, the longitudinal bars 202 can be further connected to one another via a bracket 210 mounted along the longitudinal bars 202, between the transversal bar 204 and the scoop 100. It is appreciated that the bracket 210 can further strengthen the push bar assembly 200 to avoid unintentional bending of the longitudinal bars 202 during use of the shovel 10. The bars of the push bar assembly 200 can be made of metal, such as steel for example, for reinforcing the assembly 200, although other materials are possible.

Figure 3:
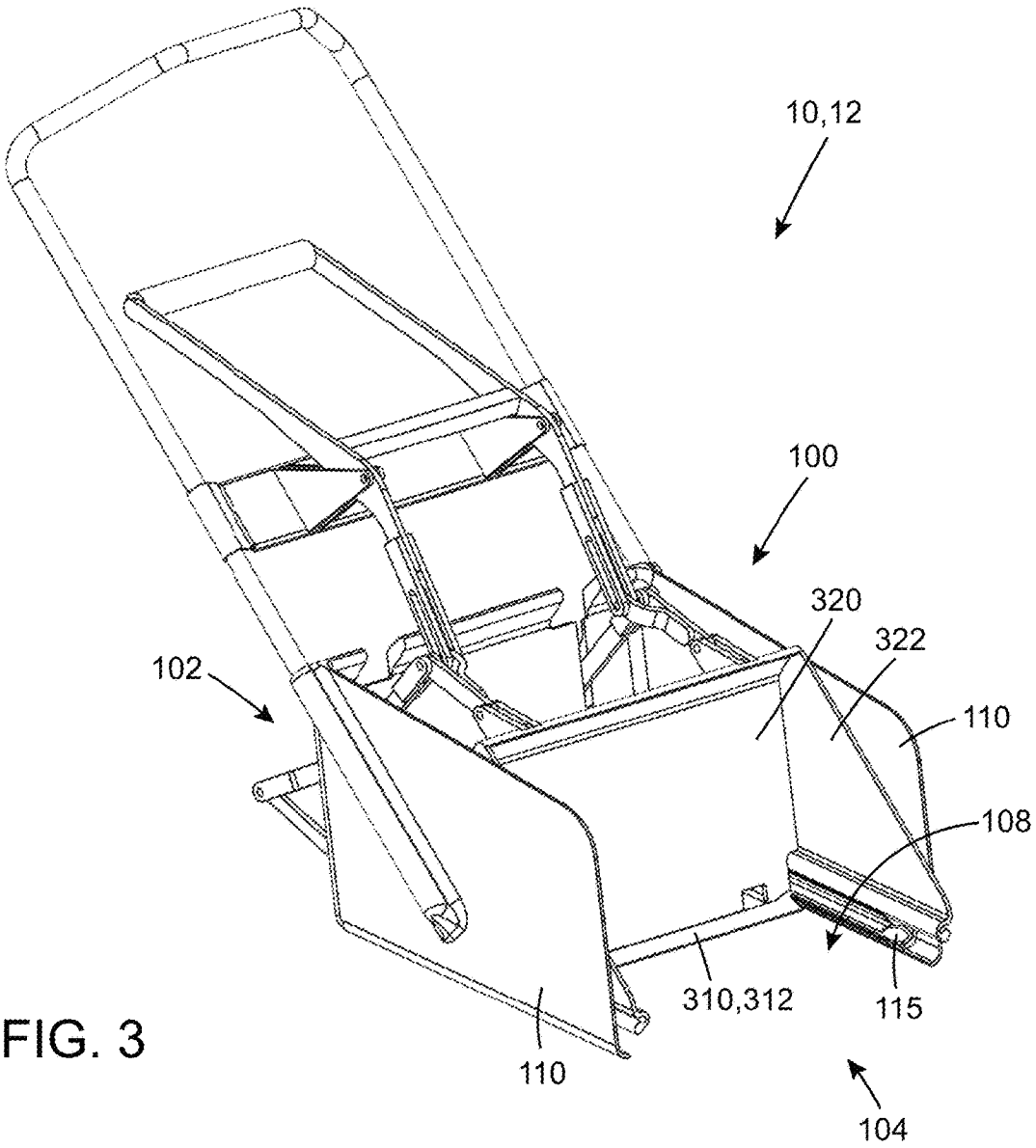
FIG. 3 is a front perspective view of the sleigh shovel shown in FIG. 1, showing an actuated discharge mechanism, according to an embodiment.
Figure 4:
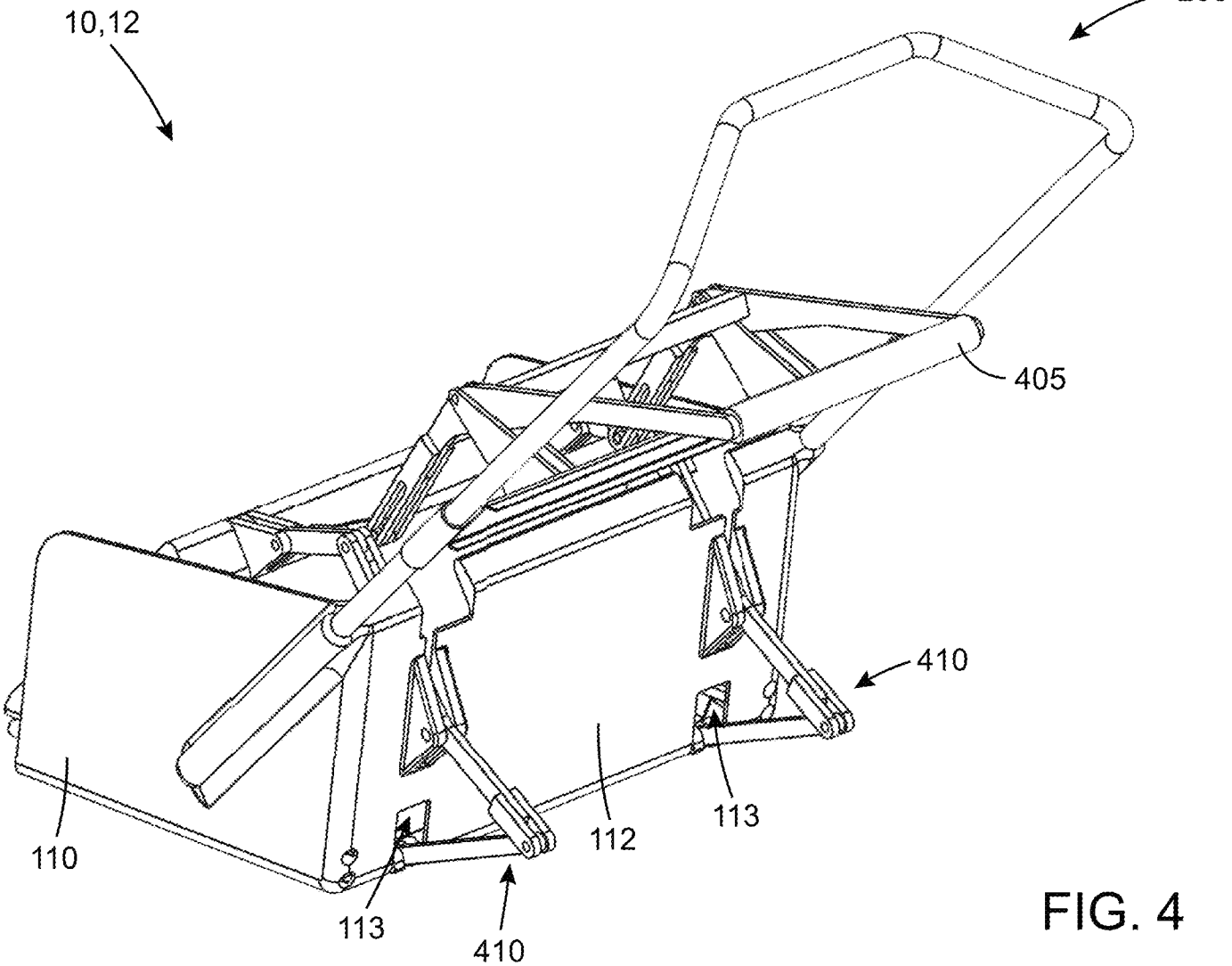
FIG. 4 is a rear perspective view of the sleigh shovel shown in FIG. 3.

Now referring to FIGS. 3 and 4, in addition to FIG. 1, the sleigh shovel 10 further includes a discharge mechanism 300 operatively connected to the scoop 100 for effectively discharging (i.e., emptying) the contents of the scoop 100. As such, the sleigh shovel 10 can be operable between a scooping configuration 11 (FIG. 1), where snow can be scooped up, contained and/or transported within the scoop interior volume 105, and a discharge configuration 12 (FIG. 3), where the scoop 100 can be emptied upon operation of the discharge mechanism 300. In this embodiment, the discharge mechanism 300 can be manually operated to change the configuration of the shovel 10 from the scooping configuration 11 to the discharge configuration 12. It should be understood that, in the context of the present disclosure, the expression "manually operated" refers to the operation of the discharge mechanism 300 without the use of tools or other mechanisms/devices.

In some embodiments, the discharge mechanism 300 includes an actuator or actuating assembly 400 in order to be operated. In other words, the discharge mechanism 300 can be manually operated to change the configuration of the shovel 10 via the actuating assembly 400. In this embodiment, the actuating assembly includes a lever 405 operatively connected to the discharge mechanism 300 in a manner that will be described further below. As seen in FIGS. 1 and 3, the lever 405 can be connected to the bracket 210 of the push bar assembly 200 to maintain the lever 405 at a desired position while solidifying the lever 405 on the shovel 10.

In some embodiments, the discharge mechanism 300 can include one or more movable/adjustable components (e.g., panels) mounted and/or connected to the scoop 100 for facilitating unloading the scoop 100. In this embodiment, the discharge mechanism 300 includes an adjustable panel 310 mounted between the lateral panels 110. More specifically, the adjustable panel 310 is mounted within the scoop 100 and is adapted to substantially cover the discharge opening 108. As such, the adjustable panel 310 can be an extension of the bottom panel 114, extending forwardly therefrom toward the front opening 106, as illustrated in FIG. 1. In some embodiments, the adjustable panel 310 and bottom panel 114 can have substantially the same size, respectively covering half the area between the lateral panels 110. However, it is appreciated that the adjustable panel 310 and the panels of the scoop 100 (e.g., bottom panel 114) can have any suitable size which can define a discharge opening 108 having, in turn, any suitable size to facilitate unloading of the scoop 100. In this embodiment, the adjustable panel 310 is made of plastic and is shaped using plastic injection molding. However, it is appreciated that other materials and/or methods of making the adjustable panel 310 are possible.

Figure 8:
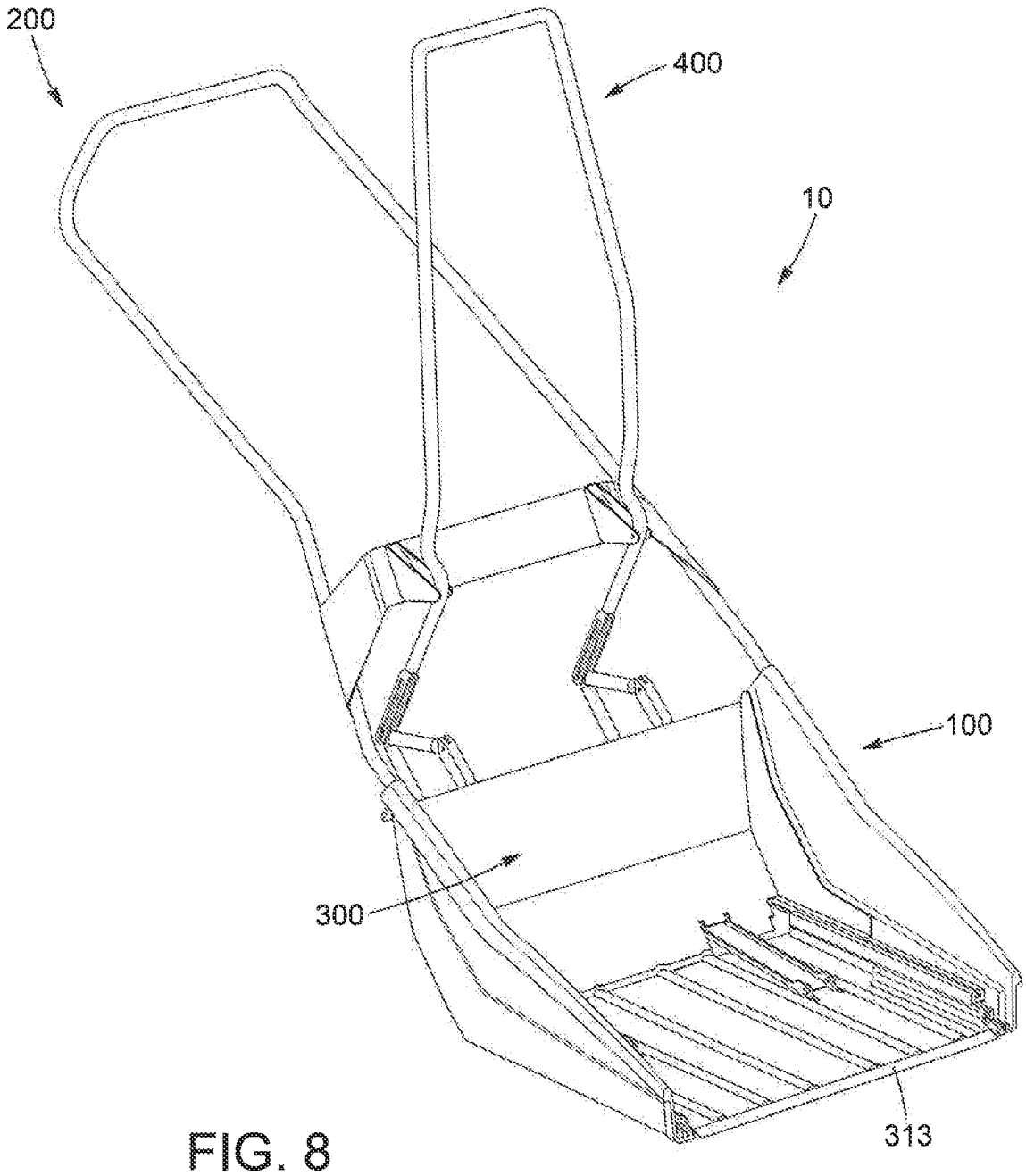
FIG. 8 is a front perspective view of a sleigh shovel having a discharge mechanism according to an alternate embodiment.
Figure 10:
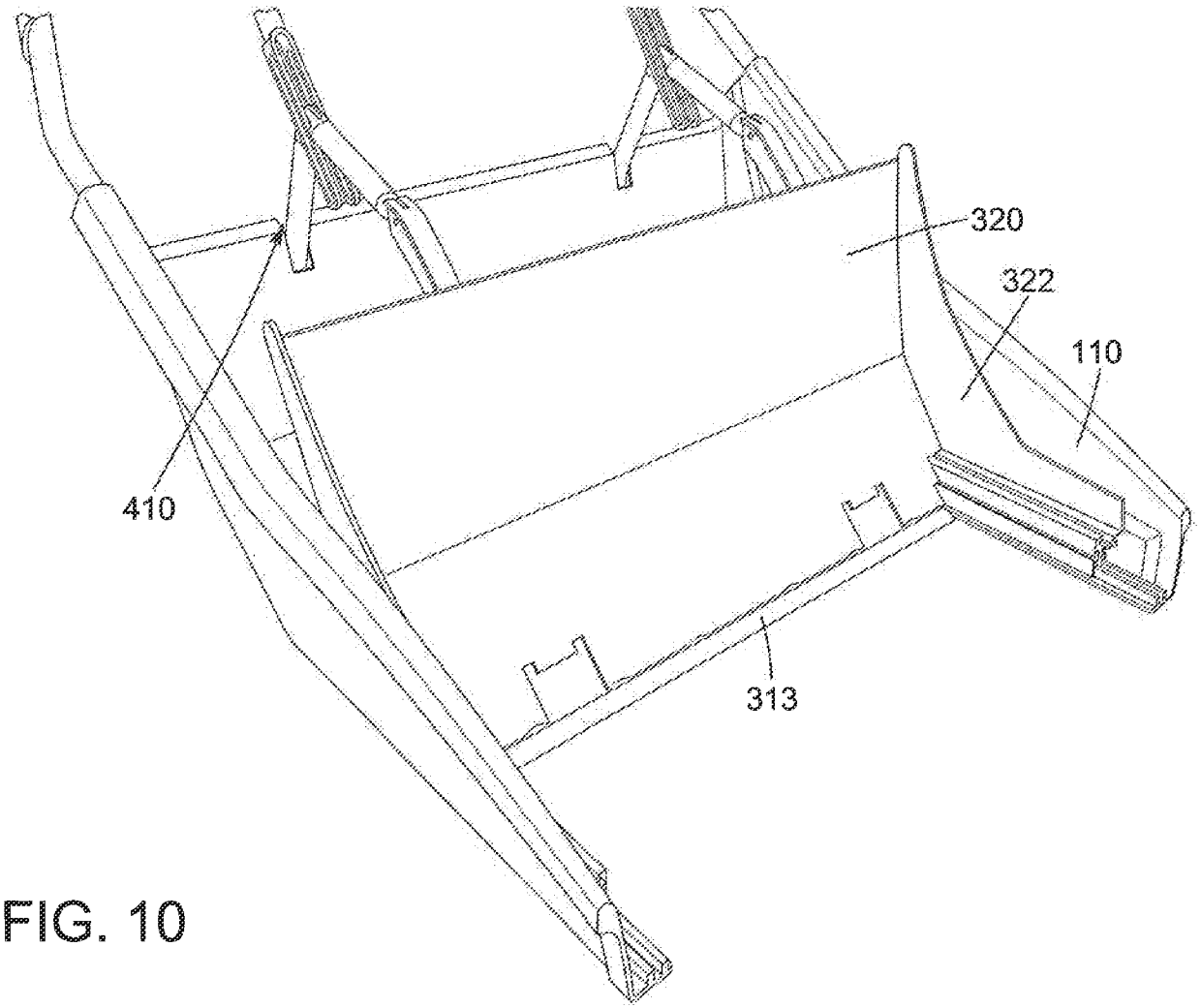
FIG. 10 is a front perspective view of the sleigh shovel shown in FIG. 8, showing an actuated discharge mechanism.

Referring to FIGS. 1 and 3, the adjustable panel 310 can be slidably connected to the scoop 100 and thus adapted to be displaced to reveal/uncover the discharge opening 108. In this embodiment, the adjustable panel 310 can be operable between an advanced position 311, where the discharge opening 108 is covered (FIGS. 1 and 2), and a retracted position 312, where the discharge opening 108 is uncovered to allow snow to exit the scoop 100 from below, through the discharge opening 108 (FIGS. 3 and 4). As such, it should be understood that the scooping configuration 11 of the shovel 10 corresponds to the adjustable panel 310 being in the advanced position 311, and that the discharge configuration 12 corresponds to the adjustable panel 310 being in the retracted position 312. In some embodiments, and as seen in FIGS. 8 and 10, the adjustable panel 310 can be provided with a reinforcement member 313 extending along a front edge thereof for providing protection to the adjustable panel 310. The reinforcement member 313 can be made of metal, such as aluminium or steel for example, and can be shaped and configured to facilitate the shoveling of snow. For example, the reinforcement member 313 can be tapered toward a forward edge thereof to help scoop snow from off the ground and into the interior volume 105.

In some embodiments, the adjustable panel 310 can be adapted to slide toward the back section 102 so that the adjustable panel 310 and bottom panel 114 substantially overlap each other. In alternate embodiments, it is appreciated that the adjustable panel 310 can slide in any suitable direction (e.g., towards the front, sideways, etc.) in order to uncover the discharge opening 108. In this embodiment, the adjustable panel 310 slides under the bottom panel 114 upon operation of the discharge mechanism 300, effectively uncovering the discharge opening 108. However, it is appreciated that the adjustable panel 310 can overlap the bottom panel 114 by sliding within the scoop interior volume 105, atop the bottom panel 114. It is further appreciated that the adjustable panel 310 can include more than one panel and can thus be split in a plurality of adjustable panels (not shown) being respectively movable/slidable in any suitable direction.

Figure 5:
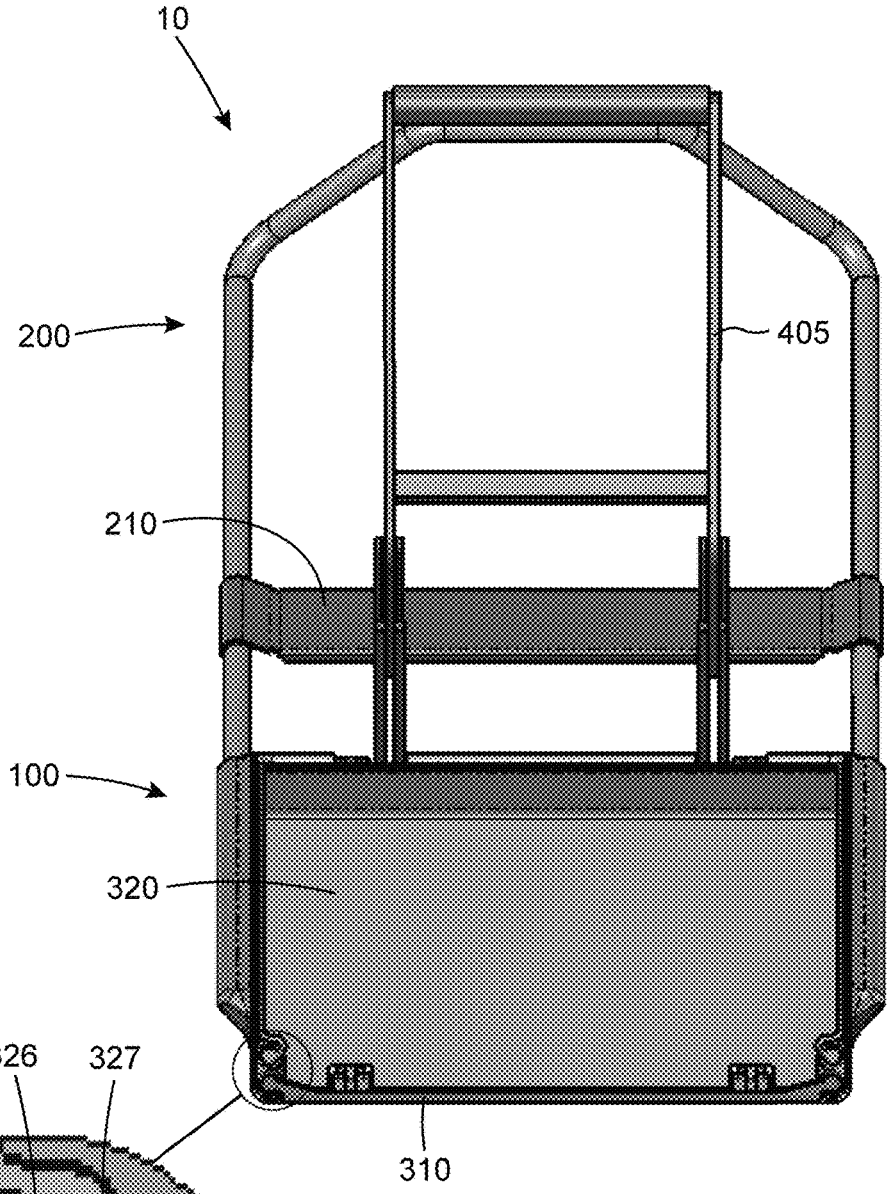
FIG. 5 is a front elevation view of the sleigh shovel shown in FIG. 1.
Figure 5A:
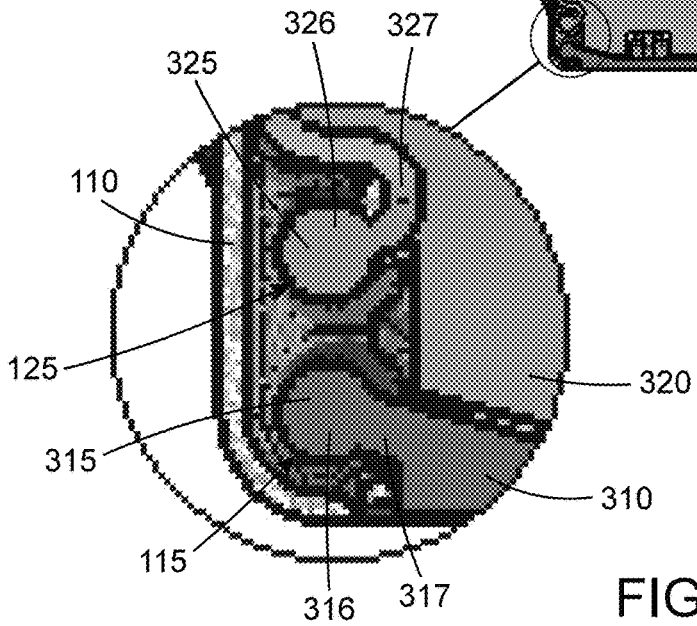
FIG. 5A is an enlarged view of the section identified in FIG. 5, showing the connections between components of the discharge mechanism and the scoop of the sleigh shovel, according to an embodiment.

In this embodiment, the adjustable panel 310 is slidably mounted to each lateral panel 110 within the scoop 100. More specifically, the adjustable panel 310 is connected to each lateral panel 110 via a tongue and groove connection. For example, and as seen in FIGS. 5 and 5A, each lateral panel 110 can include a bottom groove 115 extending along a length thereof, and the adjustable panel 310 can include protrusions 315 on either side for engaging a corresponding one of the bottom grooves 115. In the present embodiment, each protrusion 315 can be shaped and sized so as to prevent accidental disengagement from the bottom groove 115. More particularly, each protrusion 315 includes a cylindrical head 316 and a connector, or neck 317, connecting the cylindrical head 316 to the adjustable panel 310. The neck 317 is illustratively narrower than the cylindrical head 316 and can thus prevent radial movement of the protrusion 315 while within the bottom groove 115. As such, it should be understood that the adjustable panel 310 can only move along the bottom groove 115 during operation of the discharge mechanism 300. It is appreciated that other configurations of the adjustable panel 310 are possible to allow movement thereof for uncovering the discharge opening 108.

In some embodiments, the bottom grooves 115 and/or the protrusions 315 can be made of the same material, such as metal, such as a lightweight metal, such as aluminium for example. However, it is appreciated that other configurations and/or materials are possible. For example, the cylindrical head 316 of the protrusion 315 can be made of a first material, while the neck 317 can be made of a second material.

Figure 6:
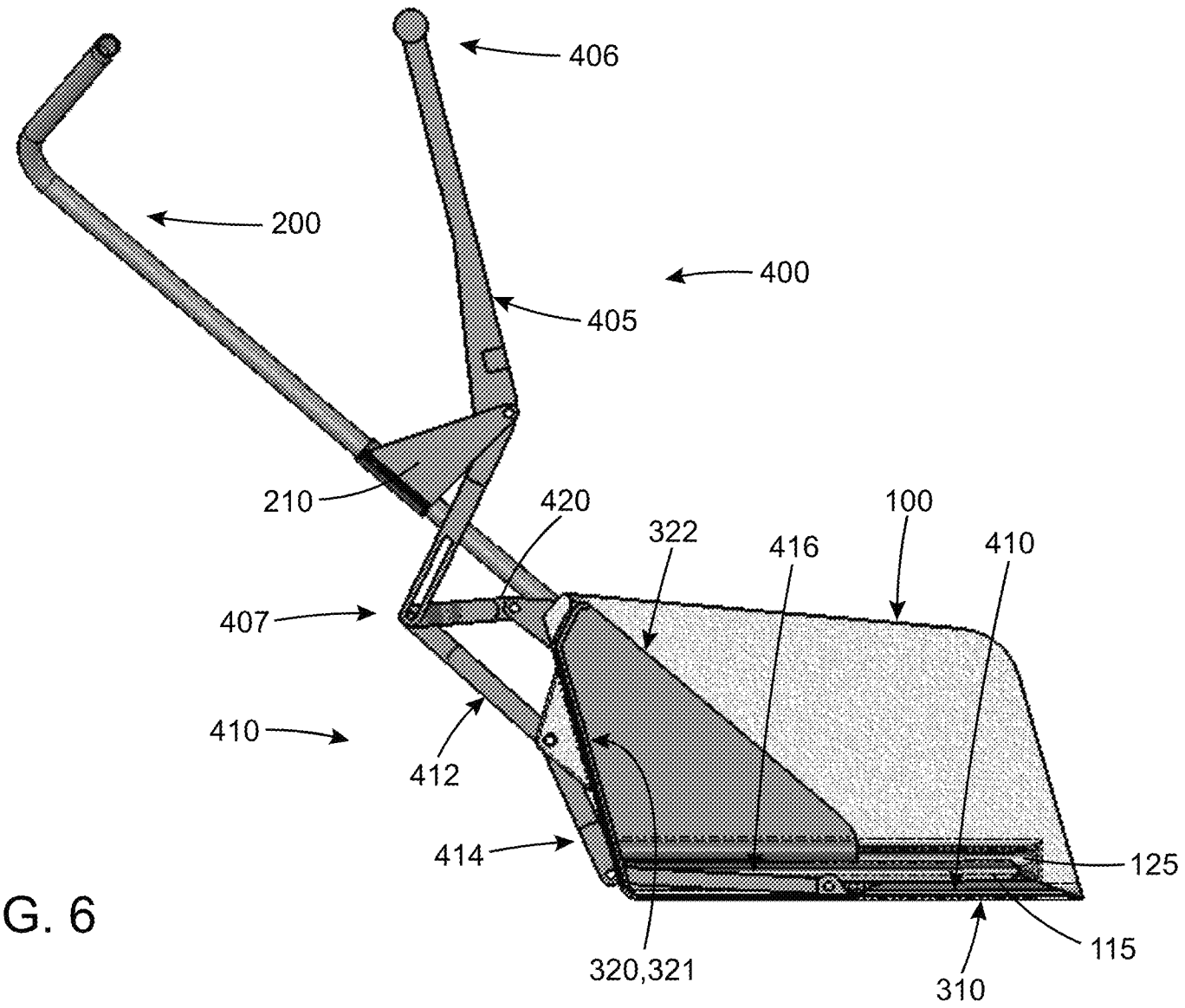
FIG. 6 is a side elevation sectional view of the sleigh shovel shown in FIG. 1, showing the shovel in a scooping configuration according to an embodiment.
Figure 7:
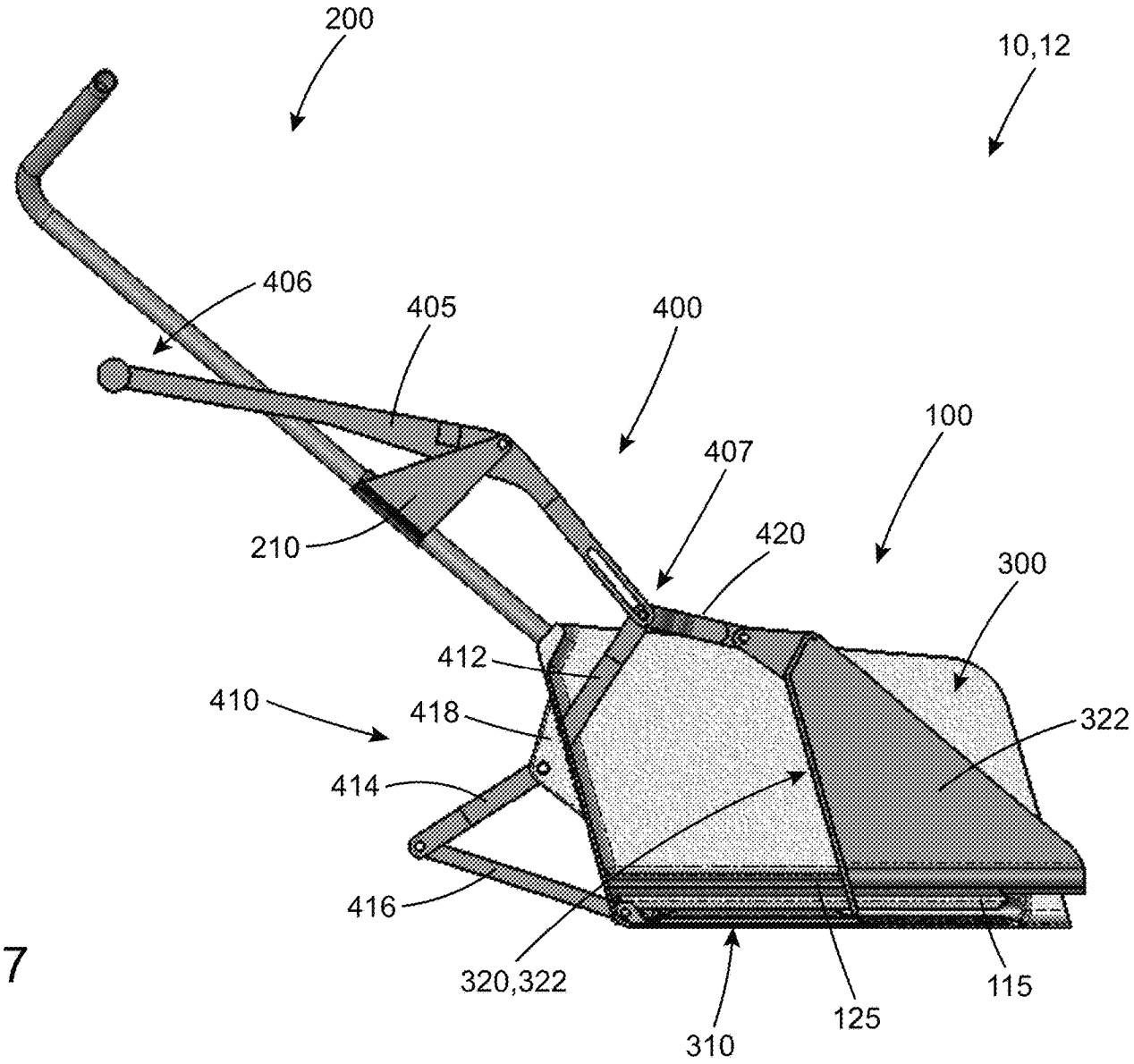
FIG. 7 is a side elevation sectional view of the sleigh shovel shown in FIG. 3, showing the shovel in a discharge configuration according to an embodiment.

Now referring to FIGS. 6 and 7, it should be noted that the adjustable panel 310 is operatively connected to the actuating assembly 400, and that manual operation of the actuating assembly 400 (e.g., pulling the lever 405) effectively displaces the adjustable panel 310 along the bottom grooves 115. In this embodiment, the actuating assembly 400 can include one or more adjustable panel arms 410 connecting the adjustable panel 310 to the lever 405. Therefore, it is appreciated that manual operation of the lever 405 effectively displaces the adjustable panel 310 along the bottom grooves via the adjustable panel arms 410. In some embodiments, the lever 405 can be pivotally connected to the bracket 210 in a central portion thereof. It should thus be understood that pulling the lever 405 substantially downwardly at a top end 406 thereof effectively rotates the bottom end 407 in the opposite direction. It is noted that the lever 405 includes two longitudinal members 408 (FIG. 1), each having a bottom end 407 for connecting with a corresponding one of the adjustable panel arms 410. However, it is appreciated that the adjustable panel arms 410 can be connected at any suitable part of the lever 405. Additionally, and as better seen in FIG. 4, the adjustable panel arms 410 can extend through openings 113 located on the rear panel 112 of the scoop 100 so as to be connected to the adjustable panel 310. However, it is appreciated that the adjustable panel arms 410 can be connected to the adjustable panel 310 in any suitable manner, such as from the side (e.g., through the lateral panels 110) or from below for example.

Still referring to FIGS. 6 and 7, each adjustable panel arm 410 can include one or more arm segments pivotally connected to one another between the lever 405 and the adjustable panel 310. As such, the adjustable panel arm 410 can be articulated so that pulling the lever 405 (i.e., raising the bottom end 407) results in the adjustable panel 310 being pulled towards the back section 102, as illustrated in FIG. 7. In this embodiment, each adjustable panel arm 410 includes a first arm segment 412, a second arm segment 414 and a third arm segment 416 pivotally connected to one another. More specifically, the first arm segment 412 is pivotally connected to the bottom end of the lever 407 and to the second arm segment 414, while the third arm segment 416 is pivotally connected to the adjustable panel 310 and the second arm segment 414. In this embodiment, the first and second arm segments are further connected to the rear panel 112 at a pivot point 418 to increase stability and allow the desired articulation between the segments of the arm 410, the lever 405 and the adjustable panel 410.

It should be noted that other configurations of the adjustable panel arm 410 are possible for connecting the lever 405 and the adjustable panel 310. For example, the adjustable panel arms 410 illustrated in FIG. 9 have a first arm segment 412 extending between the lever 405 and the third arm segment 416 which connects to the adjustable panel 310. In this embodiment, the first arm segment 412 has a substantially arcuated shape proximate the pivot point 318 such that pulling the lever 405 downwardly operates the discharge mechanism 300 (i.e., retracts the adjustable panel 310). In this embodiment, the adjustable panel arms 410 are made of aluminium, although it is appreciated that other materials are possible. In alternate embodiments, the adjustable panel arms 410 can include a chain sprocket (not shown) on any one of the segments 412, 414, 416 operable upon pulling the lever 405 to effectively retract the adjustable panel 310.

Referring back to FIGS. 1 and 3, and with further reference to FIG. 10, the discharge mechanism 300 can further include a sliding wall 320 slidably mounted within the scoop 100 proximate the back section 102. In some embodiments, the sliding wall 320 is positioned in an upright position (e.g., against the rear panel 112) and is adapted to push snow contained within the scoop 100 forwardly upon operation of the discharge mechanism 300. It is appreciated that the sliding wall 320 can conform to the shape of the rear panel 112 such that if the rear panel 112 is curved, the sliding wall 320 will be correspondingly curved (as seen in FIG. 10). The sliding wall 320 can be displaced within the scoop 100 towards the front section 104, and more specifically towards the discharge opening 108, dragging snow along its path. In some embodiments, the sliding wall 320 can be connected to each lateral panel 110 within the scoop 100 via tongue and groove connections, in a similar fashion as the adjustable panel 310. In the present embodiment, the sliding wall 320 includes lateral extensions 322 on either side to effectively connect with each lateral panel 110. It should be appreciated that the lateral extensions 322 can further support the sliding wall 320 in the upright position during operation of the shovel 10 and/or discharge mechanism 300. In this embodiment, the sliding wall 320 and lateral extensions 322 are made of the same material, which can be the same material as the panels of the scoop 100 (e.g., plastic). Moreover, it is appreciated that the sliding wall 320 and lateral extensions 322 can be made as a one-piece unit using plastic injection molding for example.

As seen in FIG. 5A, each lateral panel 110 can include a sliding wall groove 125 extending alongside corresponding bottom grooves 115, and each lateral extension can include protrusions 325 for engaging the sliding wall grooves 125. Similar to the connection of the adjustable panel 310, the protrusions 325 can include a cylindrical head 326 connected to the lateral extensions via a connector, or neck 327. As previously described, the neck 327 is illustratively narrower than then cylindrical head 326, thus preventing disengagement of the protrusion 325 from the sliding wall groove 125. Therefore, it should be understood that the sliding wall 320 can only slide back and forth within the scoop 100 along the sliding wall grooves 125.

Referring once again to FIGS. 6 and 7, the sliding wall 320 is operatively connected to the actuating assembly 400 via one or more sliding wall arms 420. More specifically, the sliding wall arms 420 are adapted to connect the sliding wall 320 to the lever 405, at the bottom end 407 thereof. Therefore, it should be understood that manual operation of the actuating assembly 400 (i.e., pulling the lever 405) displaces the sliding wall 320 along the sliding wall grooves 125 and toward the discharge opening 108. In this embodiment, the sliding wall 320 can be operable between a scooping position 321, where the sliding wall 320 substantially abuts against the rear panel 112, and a discharge position 322, where the sliding wall 320 is moved proximate the discharge opening 108. It should be apparent that the scooping configuration 11 thus corresponds to the sliding wall 320 being in the scooping position 321, and that the discharge configuration 12 corresponds to the sliding wall 320 being in the discharge position 322.

It should be noted that the sliding wall arms 420 and adjustable panel arms 410 can be connected to one another via the lever 405. More specifically, the first segments 412 and sliding wall arms 420 each connect to the lever 405 at the bottom end thereof 407. As such, it should be understood that pulling the lever 405 can effectively engage both the bottom panel arms 410 and sliding wall arms 420 simultaneously. In other words, pulling the lever 405 slides the adjustable panel 310 from the advanced position 311 to the retracted position 312 while simultaneously having the sliding wall 320 move from the scooping position 321 to the discharge position 322 in order to push the contents of the scoop 100 (e.g., snow) toward the discharge opening 108. Therefore, it is appreciated that the scoop 100 can advantageously be unloaded/discharged in one motion (i.e., by pulling the lever 405).

In some embodiments, the distance traveled by the sliding wall 320 can be substantially the same as that traveled by the adjustable panel 310. However, it should be apparent that the sliding wall 320 and adjustable panel 310 move in opposite directions, i.e., towards the front section 104 and towards the back section 102 respectively. For example, upon operation of the discharge mechanism 300, the sliding wall 320 can slide forwardly following the sliding wall groove 125 along half the length of the scoop 100, and the adjustable panel 310 can slide rearwardly following the bottom groove 115 along substantially the same distance. It should however be appreciated that the distance traveled by the sliding wall 320 can be greater than that of the adjustable panel 310, or vice-versa.

Figure 11:
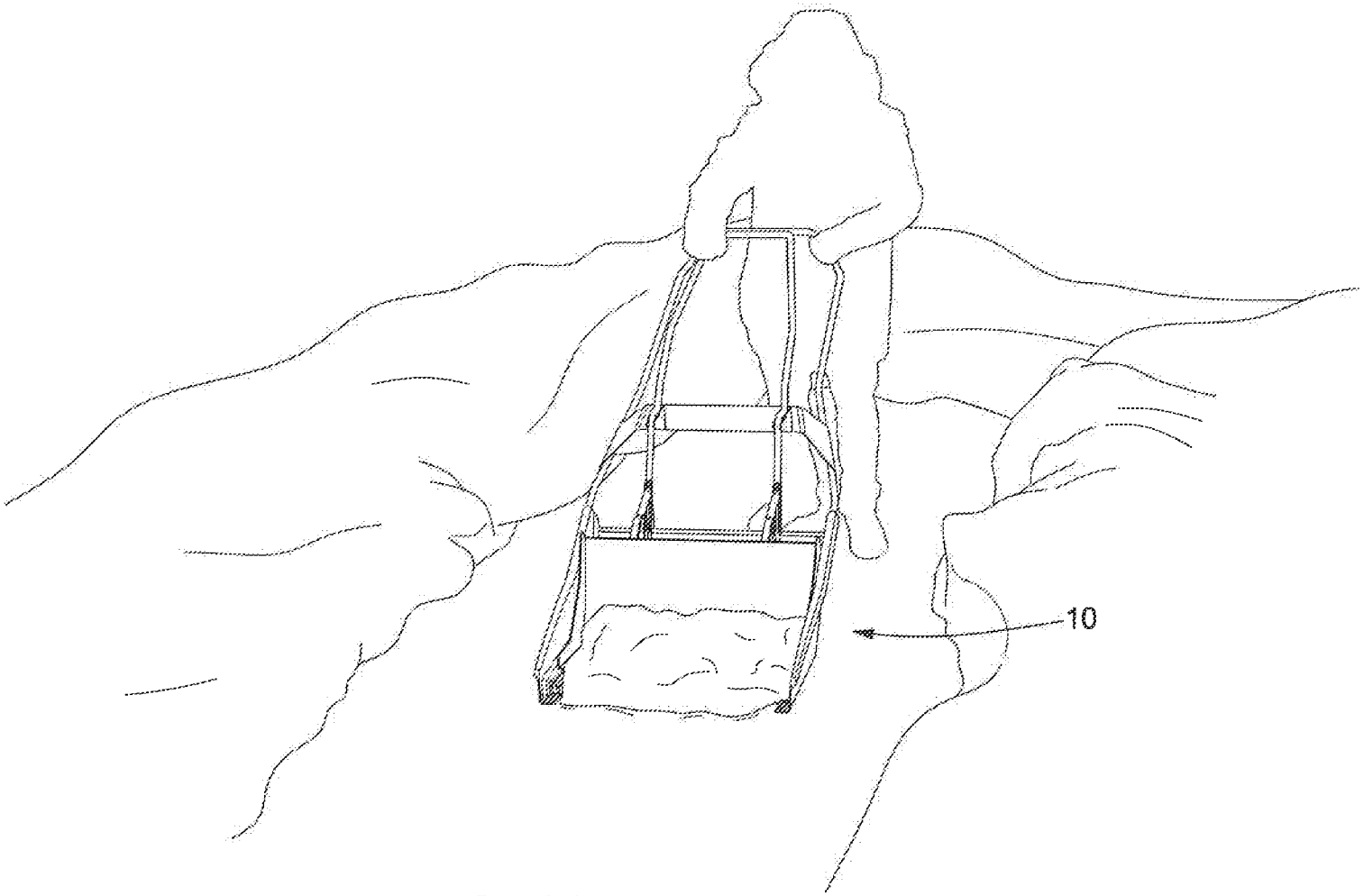
FIG. 11 illustrates an exemplary use of the sleigh shovel shown in FIG. 8, showing a user shoveling snow.
Figure 12:
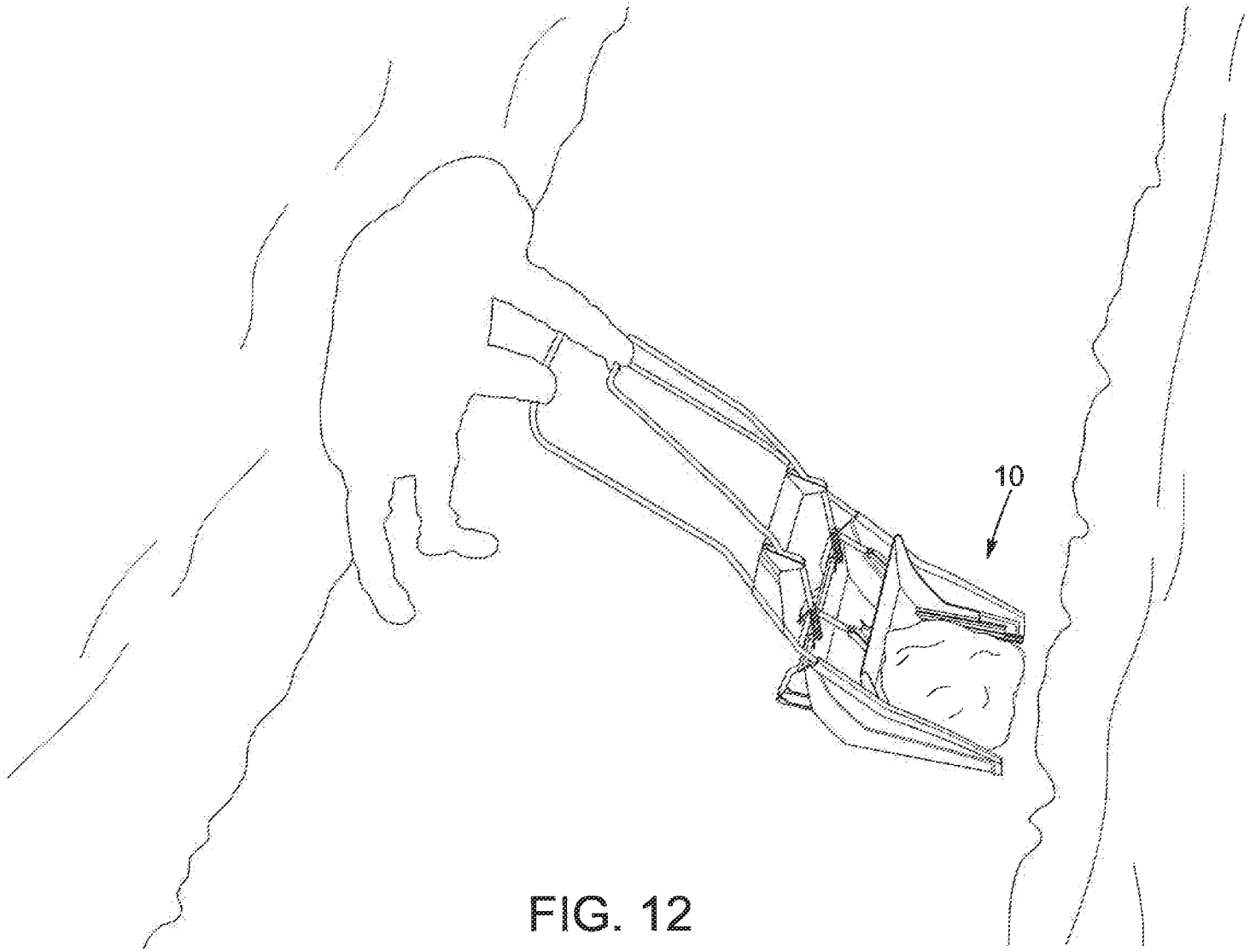
FIG. 12 illustrates an exemplary use of the sleigh shovel shown in FIG. 8, showing a user operating the discharge mechanism.

Referring broadly to FIGS. 1 through 12, a method of displacing and discharging snow using the sleigh shovel 10 as described above is provided. Firstly, the scoop 100 can be filled with snow in a conventional manner, e.g., by pushing the shovel 10 in a snow bank so as to have snow enter the scoop interior volume 105 via the front opening 106 (FIG. 11). Then, the shovel 10 can be displaced to a desired location, preferably away from the snow bank from which snow was initially collected, by pushing the scoop 100 using the push bar assembly 200. Once at the desired location, the discharge mechanism 300 can be operated by pulling the lever 405, effectively pushing the snow located in the scoop interior volume 105 toward the front section 104, and therefore toward the discharge opening 108 (FIG. 12). Once pushed, the snow will fall through the discharge opening 108, contacting the ground beneath the shovel 10. Without letting go of the lever 405, the scoop 100 can be moved away from the recently discharged snow so as to not accidentally "re-scoop" snow within the scoop interior volume 105. Finally, the lever 405 can be released so as to once again operate the shovel 10 in the scooping configuration 11 to be able to displace and discharge additional snow.

Embodiments and examples of the sleigh shovel have been described and illustrated herein. These embodiments are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the shovel may be embodied in other specific forms without departing from the central characteristics thereof. The present examples and embodiments, therefore, are to be considered in all respects as illustrative and not restrictive, and the shovel, and corresponding features, should not be limited to the details given herein. Accordingly, while specific embodiments have been illustrated and described, numerous modifications come to mind without significantly departing from the scope of the invention as defined in the appended claims.

The invention claimed is:

1. A sleigh shovel comprising:

a scoop having lateral panels, a rear panel extending between the lateral panels and a bottom panel extending between the lateral panels;

a push bar assembly extending from the scoop;

an actuation assembly;

a discharge mechanism connected to the scoop, the discharge mechanism comprising:

a sliding wall mounted within the scoop in an upright position and operatively connected to the actuation assembly; and an adjustable panel mounted between the lateral panels and operatively connected to the actuation assembly;

the sleigh shovel being operable between a scooping configuration for containing and transporting material within the scoop, and a discharge configuration, for discharging material from the scoop upon manual operation of the actuation assembly.

2. The sleigh shovel according to claim 1, wherein the panels of the scoop define a discharge opening at a front section thereof for unloading material.

3. The sleigh shovel according to claim 2, wherein the adjustable panel is operable between an advanced position and a retracted position upon operation of the actuation assembly, wherein when in the advanced position, the adjustable panel covers the discharge opening and when in the retracted position, the discharge opening is uncovered.

4. The sleigh shovel according to claim 3, wherein the discharge mechanism comprises bottom grooves positioned along the lateral panels and wherein the adjustable panel is adapted to slide along the bottom grooves upon operation of the actuation assembly.

5. The sleigh shovel according to claim 1, wherein the adjustable panel slides rearwardly, below the bottom panel, upon operation of the actuation assembly.

6. The sleigh shovel according to claim 1, wherein the sliding wall is operable between a scooping position proximate the rear panel and a discharge position proximate the discharge opening upon operation of the discharge mechanism.

7. The sleigh shovel according to claim 6, wherein the discharge mechanism comprises sliding wall grooves positioned along the lateral panels and wherein the sliding wall is adapted to slide along the sliding wall grooves upon operation of the actuation assembly.

8. The sleigh shovel according to claim 1, wherein the discharge mechanism comprises at least one adjustable panel arm operatively connecting the adjustable panel to the actuating assembly.

9. The sleigh shovel according to claim 8, wherein the adjustable panel arm comprises a plurality of segments pivotally connected to one another.

10. The sleigh shovel according to claim 1, wherein the discharge mechanism comprises at least one sliding wall arm operatively connecting the sliding wall to the actuating assembly.

11. The sleigh shovel according to claim 10, wherein the sliding wall arm and adjustable panel arm are operatively connected to one another.

12. The sleigh shovel according to claim 1, wherein the sliding wall is connected to the lateral panels via tongue and groove connections.

13. The sleigh shovel according to claim 1, wherein the adjustable panel is connected to the lateral panels via tongue and groove connections.

14. The sleigh shovel according to claim 1, wherein the actuation assembly is adapted to engage both the sliding wall and adjustable panel simultaneously.

15. The sleigh shovel according to claim 1, wherein the actuation assembly comprises a lever.

16. The sleigh shovel according to claim 15, wherein the lever is pivotally connected to the push bar assembly.

17. A sleigh shovel for shoveling snow, the sleigh shovel comprising:

a scoop for containing snow;

a push bar assembly extending from the scoop;

a discharge mechanism connected to the scoop, the discharge mechanism comprising:

an adjustable panel; and a sliding wall operatively mounted within the scoop; and an actuation assembly, the discharge mechanism being adapted to discharge the scoop from below upon manual operation of the actuation assembly.

18. The sleigh shovel according to claim 17, wherein the sliding wall comprises a substantially upright/vertical wall displaceable from a first, frontward position to a second, backward or retracted position, and wherein the discharge mechanism retracts the bottom section of the scoop while concurrently rearwardly sliding the upright vertical wall, upon being actuated from the charging to the discharging position.

* * * * *